US009626927B2

(12) United States Patent
Chen et al.

(10) Patent No.: US 9,626,927 B2
(45) Date of Patent: Apr. 18, 2017

(54) DRIVING CIRCUIT AND LIQUID CRYSTAL DISPLAY (LCD) APPARATUS THEREOF

(71) Applicant: SHENZHEN CHINA STAR OPTOELECTRONICS TECHNOLOGY CO., LTD., Guangdong (CN)

(72) Inventors: Yu-Yeh Chen, Guangdong (CN); Yin-Hung Chen, Guangdong (CN); Dongguang Wu, Guangdong (CN)

(73) Assignee: SHENZHEN CHINE STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 157 days.

(21) Appl. No.: 14/410,940

(22) PCT Filed: Sep. 19, 2014

(86) PCT No.: PCT/CN2014/086936
§ 371 (c)(1),
(2) Date: Dec. 23, 2014

(87) PCT Pub. No.: WO2016/037382
PCT Pub. Date: Mar. 17, 2016

(65) Prior Publication Data

US 2016/0078797 A1 Mar. 17, 2016

(30) Foreign Application Priority Data

Sep. 12, 2014 (CN) ..... 2014 1 0465213

(51) Int. Cl.
*G09G 5/10* (2006.01)
*G09G 3/36* (2006.01)

(52) U.S. Cl.
CPC ..... *G09G 3/3674* (2013.01); *G09G 3/3614* (2013.01); *G09G 3/3696* (2013.01);
(Continued)

(58) Field of Classification Search
CPC ... G09G 2320/0276; G09G 2320/0673; G09G 3/2007; G09G 3/3696; G09G 3/3614
See application file for complete search history.

(56) References Cited

U.S. PATENT DOCUMENTS

2007/0152951 A1* 7/2007 Ahn ..... G09G 3/342 345/102
2007/0279003 A1* 12/2007 Altemose ..... H02J 7/0016 320/118

(Continued)

FOREIGN PATENT DOCUMENTS

CN 101520998 A 9/2009
CN 102956215 A 3/2013

(Continued)

*Primary Examiner* — Hang Lin
(74) *Attorney, Agent, or Firm* — Osha Liang LLP

(57) ABSTRACT

A driving circuit comprising a signal edge cutting circuit is described. The signal edge cutting circuit comprises a first switch unit, a second switch unit and a third switch unit wherein the third switch unit decreases a voltage amplitude of the scanning signal by an edge-cutting resistor for implementing the signal edge cutting procedure of the scanning signal. The present invention further provides an LCD apparatus and employs the third switch unit for eliminating the image sticking phenomenon of the display image advantageously.

11 Claims, 5 Drawing Sheets

(52) U.S. Cl.
CPC ..... *G09G 2310/0251* (2013.01); *G09G 2320/0219* (2013.01); *G09G 2320/0223* (2013.01); *G09G 2320/0257* (2013.01)

(56) References Cited

U.S. PATENT DOCUMENTS

| | | | | |
|---|---|---|---|---|
| 2009/0251448 | A1* | 10/2009 | Kuwabara | H04N 5/20 345/207 |
| 2012/0169695 | A1* | 7/2012 | Chang | G09G 3/3648 345/211 |
| 2014/0145922 | A1* | 5/2014 | Chen | G09G 3/3677 345/94 |
| 2014/0145923 | A1 | 5/2014 | Chen | |

FOREIGN PATENT DOCUMENTS

| | | | |
|---|---|---|---|
| CN | 102956216 | A | 3/2013 |
| JP | 2001215927 | A | 8/2001 |
| JP | 2002365608 | A | 12/2002 |

* cited by examiner

DRIVING CIRCUIT AND LIQUID CRYSTAL DISPLAY (LCD) APPARATUS THEREOF

FIELD OF THE INVENTION

The present invention relates to a display technique field, and more particularly to a driving circuit and a liquid crystal display (LCD) apparatus.

BACKGROUND OF THE INVENTION

With the technical and social development, the increasing number of persons employs the LCD apparatus for entertainment activities and social intercourses. If the LCD works and maintains a still picture, the liquid crystal is driven and polarized such that liquid crystal molecules are not normal deflected by the voltage control signal. In this case, when the display image is changed from the one image to another image, the user may still see the prior image, which is defined as image sticking phenomenon As shown in FIG. 1, it is a schematic driving status view of a scanning signal and a data signal of a conventional LCD apparatus. In FIG. 1, "Vcom" is a common voltage. "Vg" is a scanning signal, "Vd" is a data signal, "Vs" is a charging voltage of pixel capacitor, and "ΔV1" is a charging loss.

The reason for image sticking phenomenon is that: when the scanning signal "Vg" is turned off, the scanning signal "Vg" induces the charging loss "ΔV1" in the falling edge of "Vg" corresponding to the coupling capacitor to the charging voltage (data signal "Vd") of pixel capacitor wherein the charging loss "ΔV1" is proportional to charging loss "ΔV2". In such a case, the profile of the charging voltage "Vs" of pixel capacitor corresponding to the common voltage "Vcom" is asymmetrical in different charging poles. In other words, regardless of the voltage polarities, i.e. positive or negative polarities, of the pixel capacitor, the scanning signal "Vg", the scanning signal "Vg" in the falling edge induces the same polar loss to the data signal "Vd". If the charging loss "ΔV1" is too large, the liquid crystal molecules cannot be driven by the data signal "Vd", resulting in image sticking.

Consequently, there is a need to develop a driving circuit and LCD apparatus to solve the aforementioned problem.

SUMMARY OF THE INVENTION

One objective of the present invention is to provide a driving circuit and an LCD apparatus to eliminate the image sticking phenomenon of the display image to solve the image sticking in the conventional driving circuit and LCD apparatus.

According to the above objective, the present invention sets forth a driving circuit and an LCD apparatus. The driving circuit for driving a liquid crystal display (LCD) and the driving circuit comprises a signal edge cutting circuit for implementing a signal edge cutting procedure of a scanning signal in order to eliminate a pixel charging voltage loss when the scanning signal is turned off, wherein the signal edge cutting circuit comprises:

a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal;

wherein an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an input end of the third switch unit couples to the output end of the first switch unit, an output end of the third switch unit grounds by way of the edge-cutting resistor, and a control end of the third switch unit couples to a second edge-cutting control signal;

wherein a polarity of the first edge-cutting control signal is opposite to that of the second edge-cutting control signal; the first edge-cutting control signal and the second edge-cutting control signal are a square waveform with a duty cycle ratio of 0.5, respectively;

wherein the signal edge cutting circuit further comprises a plurality of fourth switch units and an edge cutting selection chip;

wherein the edge cutting selection chip transmits a turn-on signal to the fourth switch unit based on a gray level range of a display image to implement the signal edge cutting procedure of the scanning signal;

wherein an input end of the fourth switch unit is coupled to the output end of the third switch unit, a control end of the fourth switch unit receives a turn-on signal, and an output end of the fourth switch unit grounds by way of the corresponding edge-cutting resistor; and wherein each of the fourth switch units has a different resistance.

In the driving circuit of present invention, the edge cutting selection chip determines the gray level range of the display image based on an average gray level value of all pixels in the display image.

In the driving circuit of present invention, the edge cutting selection chip determines the gray level range of the display image based on a gray level distribution of all pixels of the display image.

In the driving circuit of present invention, when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the second and third switch units turn off and the third switch unit turns off such that a voltage amplitude of the scanning signal is decreased by way of the third switch unit and the edge-cutting resistor.

The present invention provides a driving circuit for driving a liquid crystal display (LCD) and the driving circuit comprises a signal edge cutting circuit for implementing a signal edge cutting procedure of a scanning signal in order to eliminate a pixel charging voltage loss when the scanning signal is turned off, wherein the signal edge cutting circuit comprises:

a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal.

In the driving circuit of present invention, an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an input end of the third switch unit couples to the output end of the first switch unit, an output end of the third switch unit grounds by way of the edge-cutting resistor, and a control end of the third switch unit couples to a second edge-cutting control signal.

In the driving circuit of present invention, a polarity of the first edge-cutting control signal is opposite to that of the second edge-cutting control signal; the first edge-cutting control signal and the second edge-cutting control signal are a square waveform with a duty cycle ratio of 0.5, respectively.

In the driving circuit of present invention, the signal edge cutting circuit further comprises a plurality of fourth switch units and an edge cutting selection chip;

wherein the edge cutting selection chip transmits a turn-on signal to the fourth switch unit based on a gray level range of a display image to implement the signal edge cutting procedure of the scanning signal;

wherein an input end of the fourth switch unit is coupled to the output end of the third switch unit, a control end of the fourth switch unit receives a turn-on signal, and an output end of the fourth switch unit grounds by way of the corresponding edge-cutting resistor; and wherein each of the fourth switch units has a different resistance.

In the driving circuit of present invention, the edge cutting selection chip determines the gray level range of the display image based on an average gray level value of all pixels in the display image.

In the driving circuit of present invention, the edge cutting selection chip determines the gray level range of the display image based on a gray level distribution of all pixels of the display image.

In the driving circuit of present invention, when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the second and third switch units turn off and the third switch unit turns off such that a voltage amplitude of the scanning signal is decreased by way of the third switch unit and the edge-cutting resistor.

The present invention further provide an LCD apparatus comprising an LCD panel, a backlight source and a driving circuit, wherein the driving circuit comprises:

a driving chip of scanning signal, for generating a scanning signal;

a driving chip of data signal, for providing a data signal; and a signal edge cutting circuit, for implementing a signal edge cutting procedure of the scanning signal in order to eliminating a pixel charging voltage loss when the scanning signal is turned off, wherein the signal edge cutting circuit comprises:

a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal.

In the LCD apparatus of present invention, an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an input end of the third switch unit couples to the output end of the first switch unit, an output end of the third switch unit grounds by way of the edge-cutting resistor, and a control end of the third switch unit couples to a second edge-cutting control signal.

In the LCD apparatus of present invention, a polarity of the first edge-cutting control signal is opposite to that of the second edge-cutting control signal; the first edge-cutting control signal and the second edge-cutting control signal are a square waveform with a duty cycle ratio of 0.5, respectively.

In the LCD apparatus of present invention, the signal edge cutting circuit further comprises a plurality of fourth switch units and an edge cutting selection chip;

wherein the edge cutting selection chip transmits a turn-on signal to the fourth switch unit based on a gray level range of a display image to implement the signal edge cutting procedure of the scanning signal;

wherein an input end of the fourth switch unit is coupled to the output end of the third switch unit, a control end of the fourth switch unit receives a turn-on signal, and an output end of the fourth switch unit grounds by way of the corresponding edge-cutting resistor; and wherein each of the fourth switch units has a different resistance.

In the LCD apparatus of present invention, the edge cutting selection chip determines the gray level range of the display image based on an average gray level value of all pixels in the display image.

In the LCD apparatus of present invention, the edge cutting selection chip determines the gray level range of the display image based on a gray level distribution of all pixels of the display image.

In the LCD apparatus of present invention, when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the second and third switch units turn off and the third switch unit turns off such that a voltage amplitude of the scanning signal is decreased by way of the third switch unit and the edge-cutting resistor.

In comparison to conventional driving circuit and LCD apparatus, the driving circuit and LCD apparatus in the present invention employs the third switch unit and the edge-cutting resistors 236 for decreasing the voltage level to implement a signal edge cutting procedure to the scanning signal in order to eliminate the image sticking phenomenon of the display image to solve the image sticking in the conventional driving circuit and LCD apparatus.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
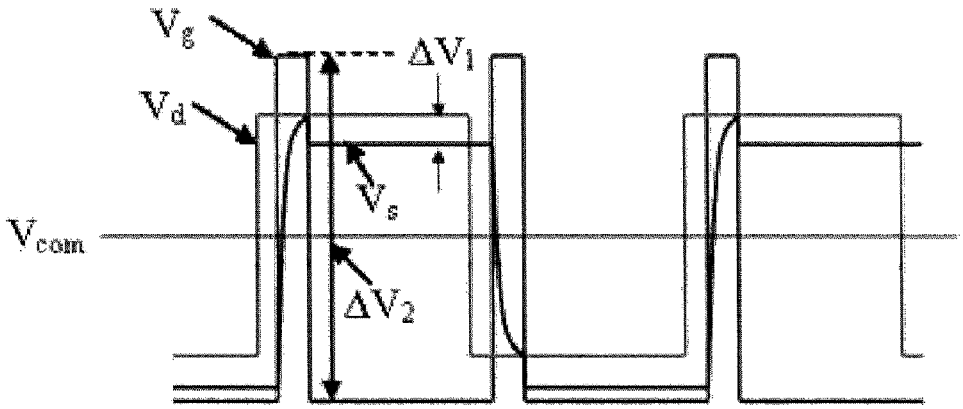
FIG. 1 is a schematic driving status view of a scanning signal and a data signal of a conventional LCD apparatus.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

Figure 2:
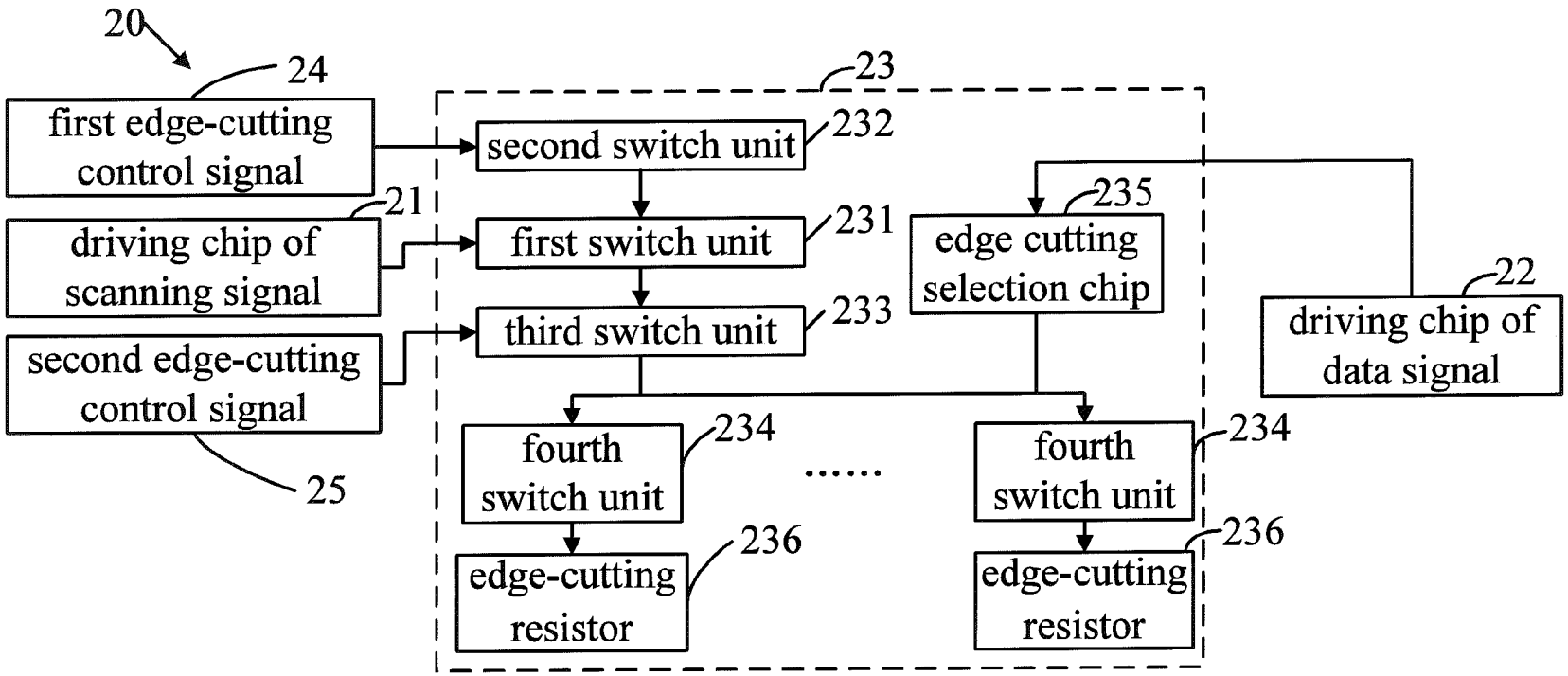
FIG. 2 is a schematic block diagrams of a driving circuit of an LCD apparatus according to one preferred embodiment of the present invention.
Figure 3:
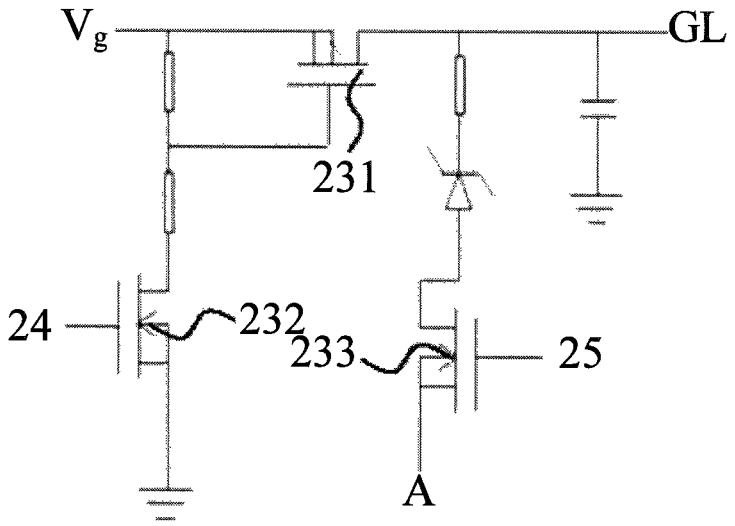
FIG. 3 is a schematic circuit structure of a signal edge cutting circuit of the driving circuit according to first preferred embodiment of the present invention.
Figure 4:
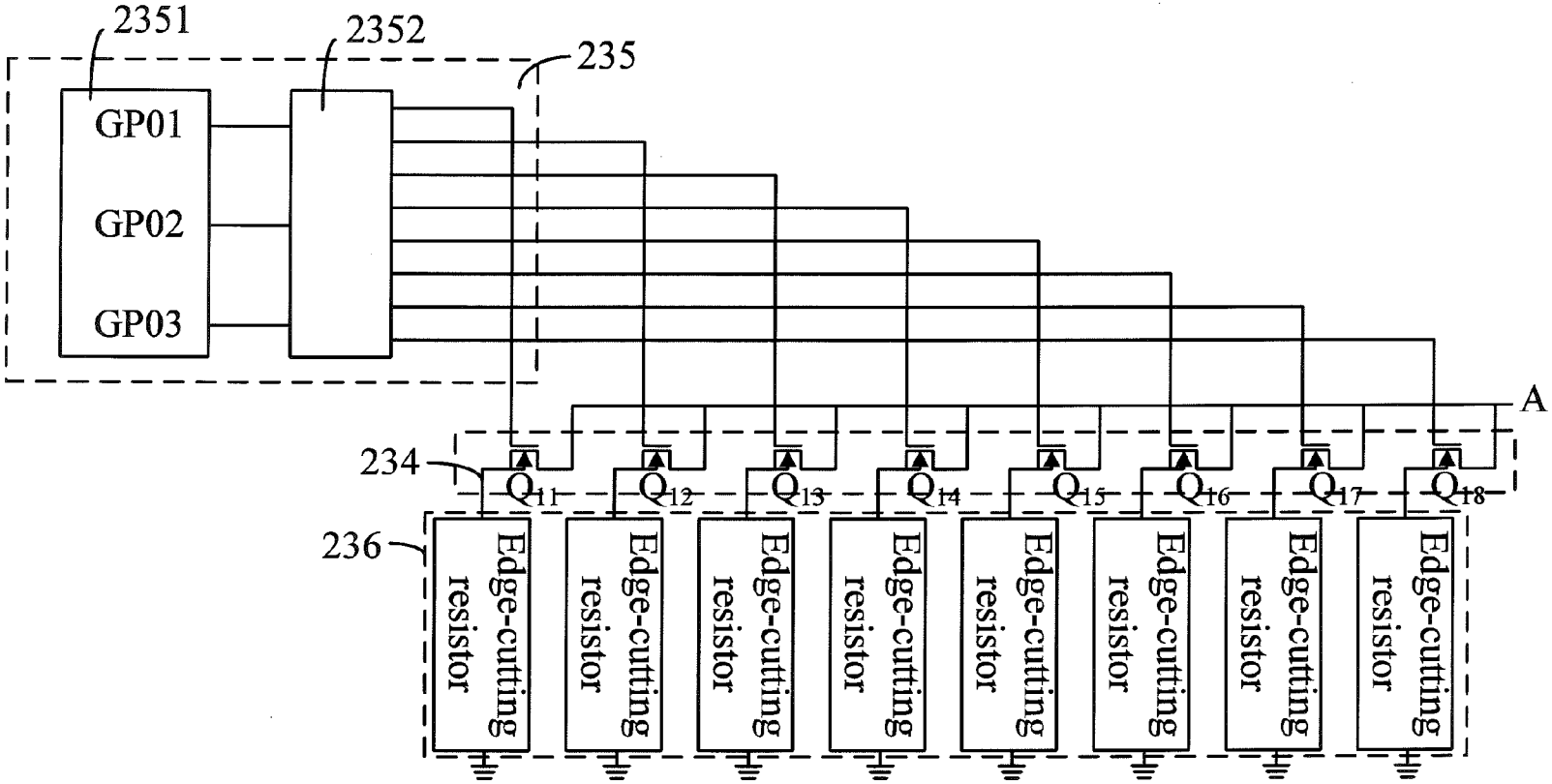
FIG. 4 is a schematic circuit structure of a signal edge cutting circuit of the driving circuit according to second preferred embodiment of the present invention.

Please refer to FIG. 2 through FIG. 4. FIG. 2 is a schematic block diagrams of a driving circuit of an LCD apparatus according to one preferred embodiment of the present invention; FIG. 3 is a schematic circuit structure of a signal edge cutting circuit 23 of the driving circuit according to first preferred embodiment of the present invention; and FIG. 4 is a schematic circuit structure of a signal edge cutting circuit 23 of the driving circuit according to second preferred embodiment of the present invention. The LCD apparatus includes a LCD panel (not shown), a backlight source (not shown) and a driving circuit 20. The LCD panel is used to display the data signal, the backlight source provides the LCD panel with the display light source, and the driving circuit 20 provides the driving signal to the LCD panel.

The driving circuit 20 includes a driving chip of scanning signal 21, a driving chip of data signal 22 and a signal edge cutting circuit 23. The driving chip of scanning signal 21 generates a scanning signal, the driving chip of data signal 22 provides the data signal, and the signal edge cutting circuit 23 is used to implement a signal edge cutting procedure of the scanning signal in order to eliminating a pixel charging voltage loss when the scanning signal is turned off.

The signal edge cutting circuit 23 includes a first switch unit (e.g. a switching transistor) 231, a second switch unit 232 and a third switch unit 233. The first switch unit 231 inputs a scanning signal, the second switch unit 232 controls on/off status of the first switch unit 231 and the third switch unit 233 cuts the profile edge of the scanning signal. In one embodiment, the third switch unit 233 decreases the voltage amplitude of the scanning signal by an edge-cutting resistor 236 for implementing a signal edge cutting procedure of the scanning signal.

As shown in FIG. 3, the input end of the first switch unit 231 is coupled to the scanning signal Vg and the output end of the first switch unit 231 outputs the scanning signal Vg to the scanning line GL. The control end of the first switch unit 231 is coupled to the input end of the second switch unit 232, the output end of the second switch unit 232 grounds, and the control end of second switch unit 232 is coupled to the first edge-cutting control signal 24. The input end of third switch unit 233 couples to the output end of first switch unit 231, the output end of third switch unit 233 grounds by way of terminal "A" and the corresponding edge-cutting resistor 236, and the control end of third switch unit 233 couples to the second edge-cutting control signal 25.

Preferably, the polarity of first edge-cutting control signal 24 is opposite to that of second edge-cutting control signal 25. In one case, the first edge-cutting control signal 24 and second edge-cutting control signal 25 are a square waveform with a duty cycle ratio of 0.5, respectively.

In FIG. 4, signal edge cutting circuit 23 further includes a plurality of fourth switch units 234 and an edge cutting selection chip 235. The edge cutting selection chip 235 transmits a turn-on signal to the fourth switch unit 234 based on a gray level range of a display image to implement a signal edge cutting procedure of the scanning signal. The input end of fourth switch unit 234 is coupled to the output end of third switch unit 233, the control end of fourth switch unit 234 receives a turn-on signal, and the output end of fourth switch unit 234 grounds by way of the corresponding edge-cutting resistor 236, wherein each of fourth switch units 234 has a different resistance.

In one preferred embodiment, the edge cutting selection chip 235 includes a timing control chip 2351 and an encoding chip 2352. The signal edge cutting circuit 23 includes eight fourth switch units 234 and corresponding edge-cutting resistors 236. The edge cutting selection chip 235 issues control signal to the encoding chip 2352 by way of three general purpose output (GPO) ports of the timing control chip 2351 such that the encoding chip 2352 generates eight different triggering signals to turn on/off the fourth switch unit 234 for decreasing the voltage level of the scanning signal by different edge-cutting resistors 236 correspondingly. Table 1 shows the status of control signals as follows.

| GPO1 | GPO2 | GPO3 | turn-on MOS |
|---|---|---|---|
| 0 | 0 | 0 | Q11 |
| 0 | 0 | 1 | Q12 |
| 0 | 1 | 0 | Q13 |
| 0 | 1 | 1 | Q14 |
| 1 | 0 | 0 | Q15 |
| 1 | 0 | 1 | Q16 |
| 1 | 1 | 0 | Q17 |
| 1 | 1 | 1 | Q18 |

The edge cutting selection chip 235 determines the gray level range of the display image based on the average gray level value of all the pixels of the display image. In one embodiment, the display image is divided into eight gray level ranges including gray levels 0 through 31, gray levels 32 through 63, gray levels 64 through 95, gray levels 96 through 127, gray levels 128 through 159, gray levels 160 through 191, gray levels 192 through 223, and gray levels 224 through 255. The various gray level ranges in the display image are capable of controlling the on/off status of the different fourth switch units 234. For example, if the average gray level value of all the pixels of the display image is gray level 80, the gray level range of the display image is within gray levels 64 through 95. At this time, fourth switch unit Q13 turns on and the rest of fourth switch units 234 turn off.

In another embodiment, the edge cutting selection chip 235 determines the gray level range of the display image based on the gray level distribution of all the pixels of the display image. In one embodiment, the display image is divided into eight gray level ranges including gray levels 0 through 31, gray levels 32 through 63, gray levels 64 through 95, gray levels 96 through 127, gray levels 128 through 159, gray levels 160 through 191, gray levels 192 through 223, and gray levels 224 through 255. If the pixels between gray levels 110 through 120 is 80 percent of all the pixels regarding to the gray level distribution of the display image, the gray level range of the display image is within gray levels 96 through 127. At this time, fourth switch unit Q14 turns on and the rest of fourth switch units 234 turn off.

Figure 5:
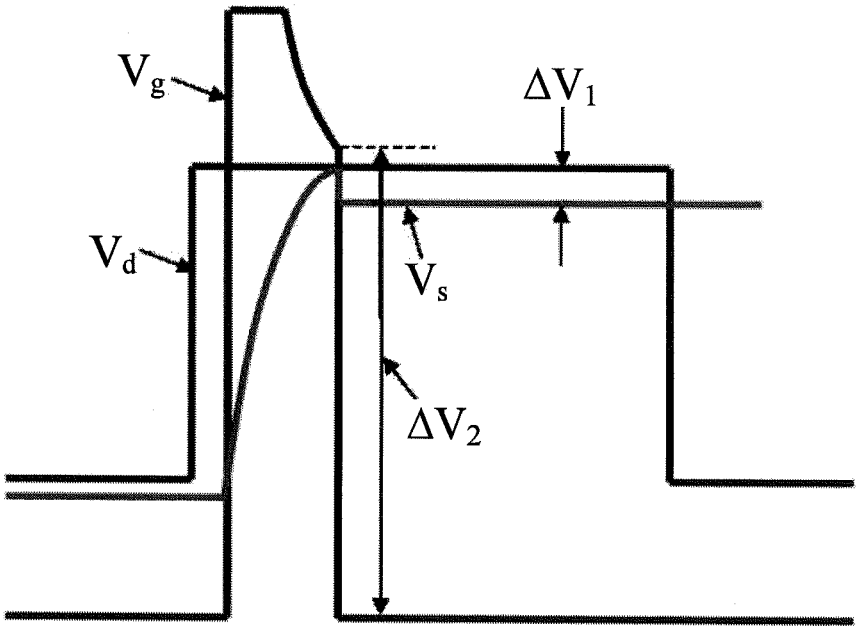
FIG. 5 is a schematic driving status view of a scanning signal and a data signal of an LCD apparatus according to one preferred embodiment of the present invention.

FIG. 2 through FIG. 5 illustrate an operation theorem of the LCD apparatus according to one preferred embodiment of the present invention. FIG. 5 is a schematic driving status view of a scanning signal and a data signal of an LCD apparatus according to one preferred embodiment of the present invention.

When the LCD apparatus displays a display image frame, the edge cutting selection chip 235 determines the gray level range of the display image based on either the average gray level value or the gray level distribution of all the pixels of the display image. The edge cutting selection chip 235 issues a turn-on signal to the corresponding fourth switch unit 234 based on the determined gray level range for triggering the corresponding fourth switch unit 234.

The driving circuit 20 of the LCD apparatus charges the pixels. The driving chip of data signal 22 of the driving circuit 20 provides the data signal to the data lines and the driving chip of scanning signal 21 of the driving circuit 20 provides the scanning signal to the scan lines. At this time, the first edge-cutting control signal 24 controls the second switch unit 232 of the signal edge cutting circuit 23 for turning on the second switch unit 232 wherein the signal level of control end of the first switch unit 231 is pulled to low level for turning on the first switch unit 231. Since the polarity of first edge-cutting control signal 24 is opposite to that of second edge-cutting control signal 25, the third switch unit 233 is controlled by second edge-cutting control signal 25 to be turned off. The scanning signal Vg is inputted to the corresponding scan line GL by way of the input end and the output end of first switch unit 231 and the data signal is inputted to the data lines correspondingly. Thus, the charging voltage Vs of the pixel capacitor raises to the signal level of data signal Vd.

During the raising process of the charging voltage Vs, the driving circuit 20 cuts the signal edge of the scanning signal Vg. In other words, the scanning signal Vg maintains a high level and decreases the voltage of the scanning signal Vg. At this time, the first edge-cutting control signal 24 controls the second switch unit 232 of the signal edge cutting circuit 23 to be turned off, and the signal level of the control end of the first switch unit 231 is in high level by the scanning signal Vg so that the first switch unit 231 is turned off. Since the polarity of second edge-cutting control signal 25 is opposite to that of first edge-cutting control signal 24, the second edge-cutting control signal 25 controls the third switch unit 233 to be turned on. Thus, the voltage signal of the scanning signal Vg on the scan line GL is transmitted by way of the third switch unit 233, the turn-on fourth switch unit 234 and the corresponding edge-cutting resistors 236 for making voltage decrement such that the scanning signal Vg is gradually decreased advantageously.

When the driving circuit 20 completes the charging procedure of the pixels, the driving chip of scanning signal 21 of the driving circuit 20 stops to provide the scanning signal to the scan line so that the voltage signal of the scanning signal Vg on the scan line rapidly is decreased. The scanning signal Vg then generates a falling edge "ΔV2" which couples to the capacitor so that charging voltage Vs of the pixel capacitor generates the charging loss "ΔV1"; meanwhile, the scanning signal on the scan line is changed to be low level so that the data signal on the data line cannot make an charging procedure to the pixel capacitor. Advantageously, since the falling edge "ΔV2" is decreased, the charging loss "ΔV1" of the charging voltage of the pixel capacitor is also diminished effectively. As a result, the image sticking phenomenon of the LCD apparatus is reduced or canceled.

Moreover, based on different gray level range of the display image, a variety of edge-cutting resistors 236 are adopted to cut the signal edge of the scanning signal Vg. In such a case, an adequate driving time interval of the scanning signal Vg and enough charging voltage of the pixel capacitor so that the effect of the charging voltage Vs of the pixel capacitor to the charging loss "ΔV1" is beneficially minimized. The values of the edge-cutting resistors 236 depend on the design requirement of the user.

According to above-mentioned descriptions, the driving circuit and LCD apparatus in the present invention employs the third switch unit and the edge-cutting resistors 236 for decreasing the voltage level to implement a signal edge cutting procedure to the scanning signal in order to eliminate the image sticking phenomenon of the display image to solve the image sticking in the conventional driving circuit and LCD apparatus.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A driving circuit for driving a liquid crystal display (LCD), the driving circuit comprising a signal edge cutting circuit for implementing a signal edge cutting procedure of a scanning signal in order to eliminate a pixel charging voltage loss when the scanning signal is turned off, wherein the signal edge cutting circuit comprises: a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal;

wherein an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an Input end of the third switch unit couples to the output end of the first switch unit, an output end of the third switch unit grounds by way of the edge-cutting resistor, and a control end of the third switch unit couples to a second edge-cutting control signal;

wherein a polarity of the first edge-cutting control signal is opposite to that of the second edge-cutting control signal; the first edge-cutting control signal and the second edge-cutting control signal are a square waveform with a duty cycle ratio of 0,5, respectively;

wherein the signal edge cutting circuit further comprises a plurality of fourth switch units and an edge cutting selection chip;

wherein the edge cutting selection chip transmits a turn-on signal to the fourth switch units based on a gray level range of a display image to implement the signal edge cutting procedure of the scanning signal;

wherein an input end of the fourth switch units is coupled to the output end of the third switch unit, a control end of the fourth switch units receives a turn-on signal, and an output end of the fourth switch units grounds by way of the corresponding edge-cutting resistor; and wherein each of the fourth switch units has a different resistance;

when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the first and second units turn off and the third switch unit turns on such that a voltage amplitude of the scanning signal is decreased by way of the third switch unit and the edge-cutting resistor.

2. The driving circuit of claim 1, wherein the edge cutting selection chip determines the gray level range of the display image based on an average gray level value of all pixels in the display image.

3. The driving circuit of claim 1, wherein the edge cutting selection chip determines the gray level range of the display image based on a gray level distribution of all pixels of the display image.

4. A driving circuit for driving a liquid crystal display (LCD), the driving circuit comprising a signal edge cutting circuit for implementing a signal edge cutting procedure of a scanning signal in order to eliminate a pixel charging voltage loss when the scanning signal is turned off, wherein the signal edge cutting circuit comprises:

a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal;

wherein the signal edge cutting circuit further comprises a plurality of fourth switch units and an edge cutting selection chip;

wherein the edge cutting selection chip transmits a turn-on signal to the fourth switch units, based on a gray level range of a display image to implement the signal edge cutting procedure of the scanning signal:

wherein an input end of the fourth switch units is coupled to the output end of the third switch unit, a control end of the fourth switch units receives a turn-on signal, and an output end of the fourth switch units grounds by way of the corresponding edge-cutting resistor: and wherein each of the fourth switch units has a different resistance;

wherein an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an input end of the third switch unit couples to the output end of the first switch unit, an output end of the third switch unit grounds by way of the edge-cutting resistor, and a control end of the third switch unit couples to a second edge-cutting control signal;

when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the first and second units turn off and the third switch unit turns on such that a voltage amplitude of the scanning signal is decreased by way of the third switch unit and the edge-cutting resistor.

5. The driving circuit of claim 4, wherein a polarity of the first edge-cutting control signal is opposite to that of the second edge-cutting control signal; the first edge-cutting control signal and the second edge-cutting control signal are a square waveform with a duty cycle ratio of 0.5, respectively.

6. The driving circuit of claim 4, wherein the edge cutting selection chip determines the gray level range of the display image based on an average gray level value of all pixels in the display image.

7. The driving circuit of claim 4, wherein the edge cutting selection chip determines the gray level range of the display image based on a gray level distribution of all pixels of the display image.

8. An LCD apparatus comprising an LCD panel, a backlight source and a driving circuit, wherein the driving circuit comprises:

a driving chip of scanning signal, for generating a scanning signal; a driving chip of data signal, or providing a data signal; and a signal edge cutting circuit, for implementing a signal edge cutting procedure of the scanning signal in order to eliminating a pixel charging voltage loss when the scanning signal is turned off, wherein the signal edge cutting circuit comprises:

a first switch unit, for inputting the scanning signal;

a second switch unit, for controlling either a turn-on status or a turn-off status of the first switch unit; and a third switch unit, for executing the signal edge cutting procedure;

wherein the third switch unit decreases a voltage amplitude of the scanning signal by an edge-cutting resistor for implementing the signal edge cutting procedure of the scanning signal;

wherein the signal edge cutting circuit further comprises a plurality of fourth switch units and an edge cutting selection chip;

wherein the edge cutting selection chip transmits a turn-on signal to the fourth switch units based on a gray level range of a display image to implement the signal edge cutting procedure of the scanning signal:

wherein an input end of the fourth switch units is coupled to the output end of the third switch unit, a control end of the fourth switch units receives a turn-on signal, and an output end of the fourth switch units grounds by way of the corresponding edge-cutting resistor; and wherein each of the fourth switch units has a different resistance;

wherein an input end of the first switch unit is coupled to the scanning signal and an output end of the first switch unit outputs the scanning signal; a control end of the first switch unit is coupled to an input end of the second switch unit, an output end of the second switch unit grounds, and a control end of the second switch unit is coupled to a first edge-cutting control signal; and an input end of the third switch unit couples to the output end of the first switch unit, an output end of the third switch unit grounds by way of the edge-cutting resistor, and a control end of the third switch unit couples to a second edge-cutting control signal;

when the driving circuit performs a pixel charging procedure, the second switch unit turns on; when the first switch unit turns on, the first switch unit outputs the scanning signal; and when the third switch unit turns off, the scanning signal is inputted to a corresponding scan line; and when the driving circuit implements the signal edge cutting procedure of the scanning signal, the first and second switch units turn off and the third switch unit turns on such that a voltage amplitude of the scanning signal is decreased by way of the third switch unit and the edge-cutting resistor.

9. The LCD apparatus of claim 8, wherein a polarity of the first edge-cutting control signal is opposite to that of the second edge-cutting control signal; the first edge-cutting control signal and the second edge-cutting control signal are a square waveform with a duty cycle ratio of 0.5, respectively.

10. The LCD apparatus of claim 8, wherein the edge cutting selection chip determines the gray level range of the display image based on an average gray level value of all pixels in the display image.

11. The LCD apparatus of claim 8, wherein the edge cutting selection chip determines the gray level range of the display image based on an average gray level distribution of all pixels in the display image.

* * * * *